US011002089B2

(12) United States Patent
Wright

(10) Patent No.: US 11,002,089 B2
(45) Date of Patent: May 11, 2021

(54) MOTION COMPENSATING FLOOR SYSTEM AND METHOD

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 16/462,149

(22) PCT Filed: Nov. 17, 2017

(86) PCT No.: PCT/US2017/062392

§ 371 (c)(1),
(2) Date: May 17, 2019

(87) PCT Pub. No.: WO2018/094264

PCT Pub. Date: May 24, 2018

(65) Prior Publication Data

US 2019/0330934 A1 Oct. 31, 2019

Related U.S. Application Data

(60) Provisional application No. 62/423,238, filed on Nov. 17, 2016.

(51) Int. Cl.
*E21B 19/09* (2006.01)
*E21B 19/00* (2006.01)
(Continued)

(52) U.S. Cl.
CPC ..... *E21B 19/09* (2013.01); *E21B 19/006* (2013.01); *E02B 17/02* (2013.01); *E21B 17/085* (2013.01); *E21B 19/22* (2013.01); *F05B 2240/95* (2013.01)

(58) Field of Classification Search
CPC ..... E21B 19/006; E21B 19/09
(Continued)

(56) References Cited

U.S. PATENT DOCUMENTS 4,215,950 A * 8/1980 Stevenson ..... E21B 7/128 405/168.4
4,886,397 A * 12/1989 Cherbonnier ..... E21B 19/09 405/195.1

(Continued)

FOREIGN PATENT DOCUMENTS

CN 103498642 A * 1/2014
EP 2617918 B1 5/2006
WO WO 2011/133552 A1 * 10/2011

OTHER PUBLICATIONS

Abstract of Chinese document CN 103498642 (Year: 2014).*

*Primary Examiner* — Sunil Singh

(57) ABSTRACT

A motion compensating system and method for use on a vessel during well intervention operations through a riser. The system can comprise an upper floor having an opening therethrough, a lower base having an opening therethrough positioned below the upper floor, a first plurality of cylinders extending between the upper floor and lower base, and a riser tensioner. Each cylinder of the plurality of cylinders can be pivotally connected to the upper floor and lower base for moving the upper floor with respect to the lower base. The riser tensioner can have an upper portion, lower portion, and central cavity extending longitudinally through the upper and lower portions, wherein the upper portion can be adapted for connection with a riser or an intermediate tubular member that is connectable to the riser. The lower portion can be connected to the lower base within or about the opening of the lower base.

18 Claims, 6 Drawing Sheets

(51) Int. Cl.
*E02B 17/02* (2006.01)
*E21B 17/08* (2006.01)
*E21B 19/22* (2006.01)

(58) Field of Classification Search
USPC ..... 166/355; 405/202, 224.4
See application file for complete search history.

(56) References Cited

U.S. PATENT DOCUMENTS

| | | | | |
|---|---|---|---|---|
| 5,310,007 | A * | 5/1994 | Parikh | E21B 19/006 166/355 |
| 6,554,072 | B1 * | 4/2003 | Mournian | E21B 19/006 166/355 |
| 7,025,553 | B1 | 4/2006 | Thomas et al. | |
| 9,181,761 | B2 * | 11/2015 | Hafernik | E21B 17/012 |
| 9,528,329 | B2 * | 12/2016 | Pallini, Jr. | E21B 19/006 |
| 2008/0031692 | A1 * | 2/2008 | Wybro | B63B 21/502 405/224.4 |
| 2011/0017595 | A1 | 1/2011 | Vandenbolcke et al. | |
| 2011/0280668 | A1 * | 11/2011 | Norwood | E21B 19/006 405/224.4 |
| 2012/0207550 | A1 | 8/2012 | Aksel et al. | |
| 2012/0241164 | A1 | 9/2012 | Coles | |
| 2014/0186125 | A1 | 6/2014 | Andresen et al. | |
| 2015/0368992 | A1 * | 12/2015 | Pallini, Jr. | E21B 19/006 405/224.4 |

* cited by examiner

MOTION COMPENSATING FLOOR SYSTEM AND METHOD

REFERENCE TO RELATED APPLICATIONS

The present application is a US national stage application claiming priority to Patent Cooperation Treaty (PCT) application No. PCT/US17/62392, filed 17 Nov. 2017, that in turn claims priority to and benefit of U.S. Provisional Application No. 62/423,238, filed 17 Nov. 2016, and entitled "Motion Compensating Floor System and Method." The entire content of the above-referenced Patent Cooperation Treaty (PCT) application No. PCT/US17/62392 is incorporated herein by reference.

FIELD

Embodiments usable within the scope of the present disclosure relate, generally, to systems and methods usable to compensate for relative motion between a vessel, a work platform, and subsea riser. More specifically, embodiments usable within the scope of the present disclosure include low cost, portable, and reusable systems and methods for reducing or eliminating relative motion caused by wind, waves, sea swells, and/or underwater currents, experienced between a vessel, a work floor or platform, and/or a subsea riser while performing well intervention, subsea equipment installation, and similar operations from the work floor or platform.

BACKGROUND

Conventional operations upon, through, and/or using a subsea riser generally require the use of a rig or platform, which is stabilized against a large portion of the heave motions and other forces and/or movements created by ocean currents, winds, and other natural conditions. Alternatively or additionally, various motion compensation systems can be used in association with the risers to prevent relative movement between the riser and an operational structure to prevent damage to the riser and/or the structure. Even when the riser is stabilized in such a manner, movement of a vessel, platform, or rig, used to access the riser, can hinder or eliminate the ability to perform various operations, and/or cause damage. Thus, conventional approaches require most subsea operations (e.g., acid injections and stimulations, decommissioning, hydrate remediation, plugging and abandonment operations, etc.) to be performed using a platform that provides sufficient stability and performance characteristics necessary for such operations. As such, relative movement between a subsea riser and an operational platform or similar structure must be strictly limited.

A need exists for systems and methods usable for accessing and performing operations upon, through, and/or using a subsea riser that can be performed riglessly, e.g., using a marine vessel in lieu of a conventional rig or platform, for enabling lower cost and faster operations that require less time for setup and deconstruction procedures.

A need also exists for systems and methods usable to perform such operations by compensating for environmental conditions, such as wind, waves, water swells, and other forces imparted to marine vessels and/or the subsea riser, which cause relative motions (e.g., heave, pitch, roll, and yaw) that are greater in magnitude than those experienced by larger platforms or other floating production facilities.

A further need exists for systems and methods that overcome the shortcomings of conventional motion compensating systems, which accommodate only a limited range of relative motion and only along limited axes.

Conventional compensation systems are rigidly integrated into the frame, deck, and/or hull of a structure. After completion of subsea operations, such an assembly cannot be removed and/or transported quickly and easily, to enable replacement with other job specific tools. An additional need exists for systems and methods that are less expensive, more efficient, portable, and able to be used and transported between vessels and operational sites as needed.

A need exists for systems and methods capable of dampening, or even eliminating, relative motion between a riser, a vessel, and equipment located on the vessel, such as a coiled tubing stack or similar conduit, thus preventing relative motion between a riser and an inner tubular string extending within the riser.

Embodiments usable within the scope of the present disclosure meet these needs.

Figure 1:
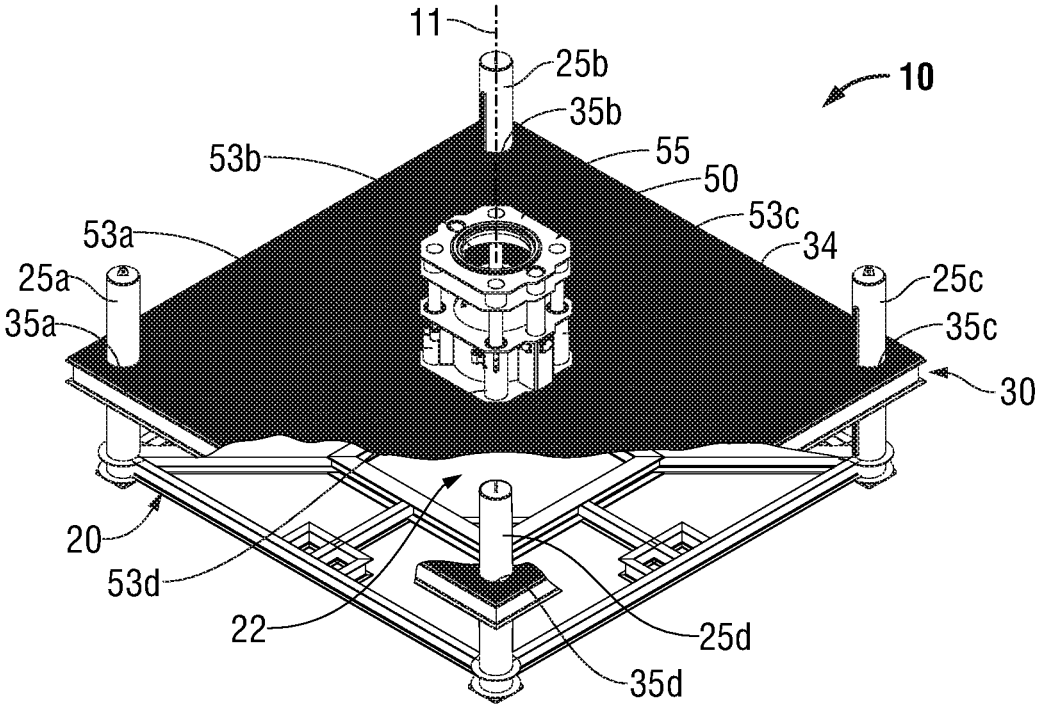
FIG. 1 depicts an isometric view of an embodiment of a motion compensating floor system usable within the scope of the present disclosure.

The present embodiments are detailed below in reference to the figures as listed above.

SUMMARY

Embodiments usable within the scope of the present disclosure include apparatuses, systems, and methods for compensating for the motion of a vessel so as to prevent damage to a riser.

The present disclosure is directed to a moveable platform system. The apparatus can comprise an upper floor and lower base, having openings therethrough, where a first plurality of cylinders connect the upper platform to the lower platform, the first plurality of cylinders being pivotally connected between the upper floor and lower base, and a second plurality of cylinders connecting the upper platform to a riser tensioner, the riser tensioner comprising an upper and lower portion and a central cavity extending longitudinally therethrough, the upper portion adapted for connection with the riser (or intermediate tubular connected to the riser), and the lower portion connected to the lower base at the opening thereof. In an embodiment, the first plurality of cylinders are connected to the upper floor and the lower base around the openings thereof, optionally at eight locations around the opening of the upper floor. In an embodiment, the first plurality of cylinders comprise four pairs of two, each pair forming a V-shaped configuration with the lower ends in close proximity and the upper ends further apart. In an embodiment, the system comprises a counterweight in connection with and balancing the upper floor against the weight of subsea/downhole equipment on the upper floor, the counterweight being optionally movable along the upper floor to adjust the balancing forces in response to a change in weight of the equipment. In other embodiments, the lower base may be adapted for connection to the deck or hull of a vessel over its moon pool, the upper floor may be adapted to receive a coiled tubing injector and reel, and there may be a telescoping tubular member extending between the opening of the upper floor and the riser tensioner.

The present disclosure is also directed to a motion compensating system for stabilizing equipment, such as coil injection tubing, located on a riser platform. Such a system can comprise an upper floor and lower base, each having an open space therein, the upper floor movable with respect to the lower base, and a riser tensioner apparatus comprising a bracket and base portion, each having a central open space, wherein the bracket portion is connected with the riser (or intermediate tubular connected with the riser), the base portion is connected to the lower base, and the bracket is movable with respect to the base portion. In another embodiment, the plurality of cylinders extend pivotal connections between the upper floor and the lower base around their respective open spaces, for moving the upper floor with respect to the lower base. In another embodiment, the riser tensioner comprises a second plurality of cylinders between the bracket and base portion. In another embodiment, the lower base is adapted for connection to a vessel's deck or hull over its moon pool. In still another embodiment, the system comprises a counterweight in connection with and balancing the upper floor against the weight of subsea/downhole equipment on the upper floor, the counterweight being optionally movable along the upper floor to adjust the balancing forces in response to a change in weight of the equipment.

The present disclosure is further directed to a method for compensating for sea surface motion on a riser platform by positioning the riser platform above a base platform connected to the vessel, actuating a first plurality of hydraulic cylinders connecting the riser platform and base platform in response to motion of the vessel to keep the riser platform at a constant level relative to the riser platform, and actuating a second plurality of hydraulic cylinders connected a riser tensioner to the riser platform in response to motion of the riser platform to keep a constant tension relative to a riser. In another embodiment, the method further comprises actuating the position of a counterweight on the riser platform to compensate for a change in weight thereon, or positioning the riser platform over a moon pool of a vessel, or differentially actuating individual hydraulic cylinders in response to pitch, roll, and/or yaw motions by the vessel. In still another embodiment, the method comprises rotatably connecting the riser to the riser tensioner and permitting the riser tensioner to have a range of angular motion relative to the riser.

The foregoing is intended to give a general idea of the invention, and is not intended to fully define nor limit the invention. The invention will be more fully understood and better appreciated by reference to the following description and drawings.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments usable within the scope of the present disclosure relate to a motion compensating floor system, which can be portable or usable on existing vessels or platforms that experience motion, e.g., motion of the sea water. For example, an embodiment of the floor system can include a single compensating platform, thus limiting the total height of the system and providing a compact, portable system that can be lifted (e.g., via a crane), placed over a moon pool or similar feature of a vessel or a platform, and attached to the deck or other suitable part of the vessel or platform. Prior to installation, one should consider variables such as the vessel or platform type, the weight of the riser, water depth, time of the year or season, and water conditions typically encountered in the geographical region. After completion of intervention operations, the floor system can be removed from the vessel for transport to another site.

It is well known that certain conditions produce calm seas. While other conditions, such winter weather, can produce high seas that are significantly more choppy or rough. These conditions cause the vessel to heave, pitch, roll and/or yaw. Unlike a riser used on rig or a platform connected to the sea floor, the movement of the vessel or a floating platform caused by the sea can overload, or even break, the riser. Even if the riser does not fail, high loads can fatigue the riser and reduce operational life. As such, the motion compensating floor system disclosed herein can reduce or eliminate relative motion between the riser and the operational or work area on the vessel adjacent to the riser during deployment of subsea packages, slickline, coiled tubing, and other downhole or deepwater equipment for intervention and other operations, such as snubbing, performed upon, through, and/or using a subsea riser. Lastly, the floor system can further reduce or eliminate relative motion between the intervention tools within the riser caused by the heave, pitch, roll, and yaw motions of the vessel.

Figure 2A:
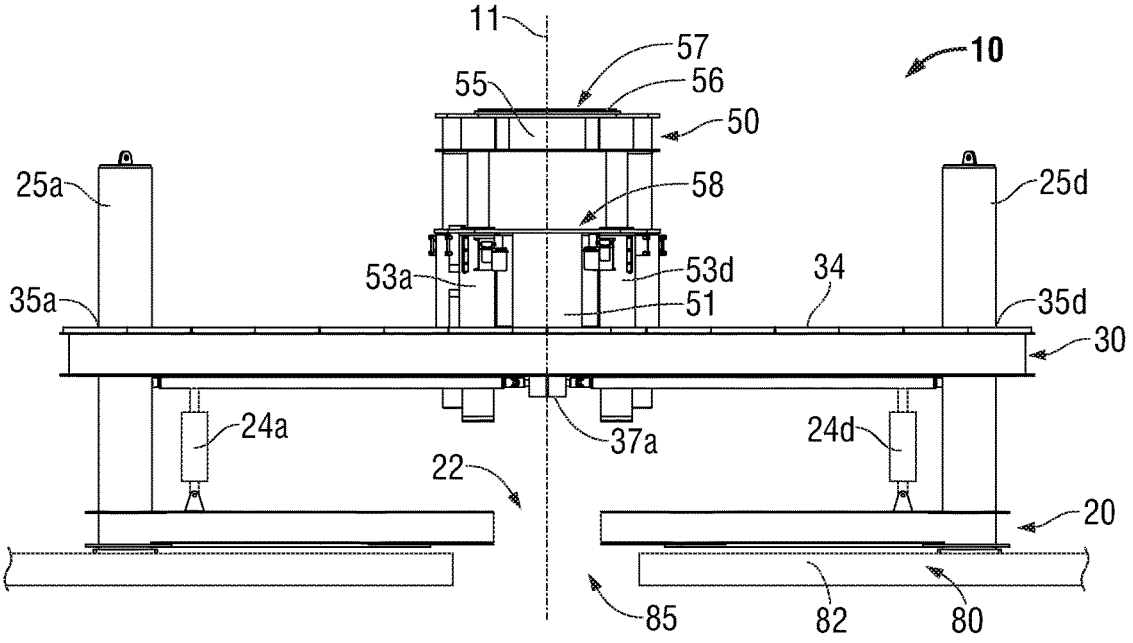
FIG. 2A depicts a side elevational view of the motion compensating floor system depicted in FIG. 1.
Figure 2B:
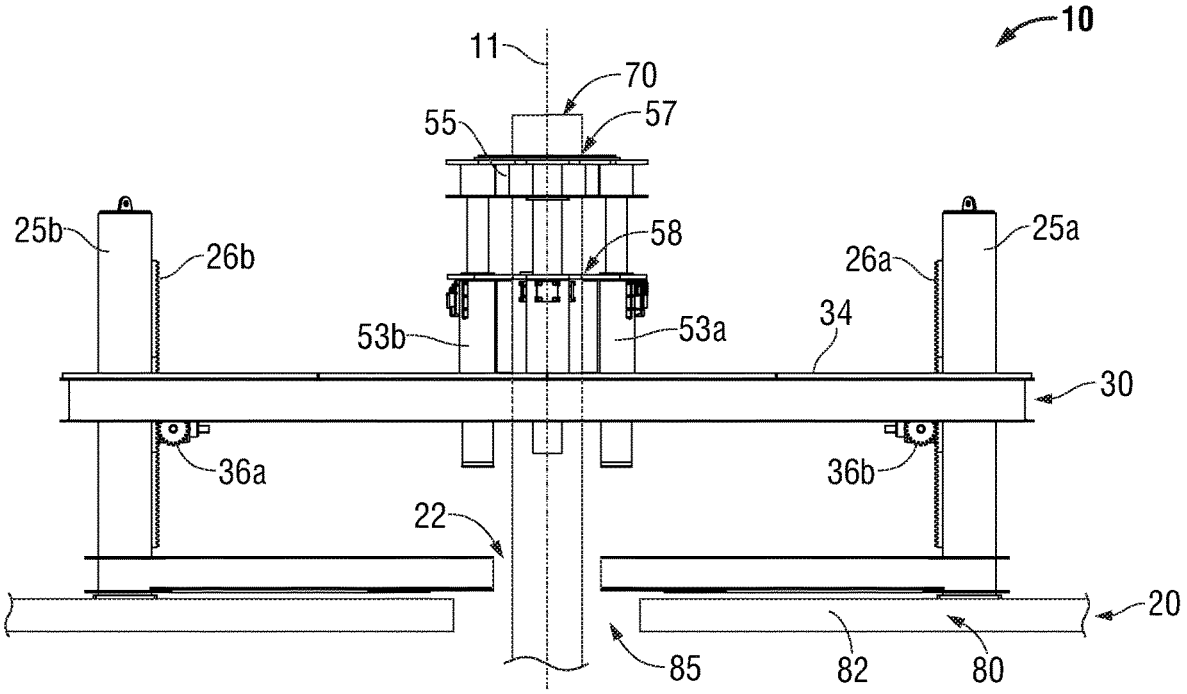
FIG. 2B depicts a front elevational view of the motion compensating floor system depicted in FIG. 1.

FIG. 1 depicts an isometric view of an embodiment of a motion compensating floor system (10), hereinafter referred to as the floor system, usable within the scope of the present disclosure. FIGS. 2A and 2B depict front and side views of the floor system (10), respectively. The depicted embodiment of the floor system (10) includes a base (20), shown as a frame adapted for positioning and/or attachment to a deck of a vessel (80, see FIG. 8) or a similar structure, having an open area (22) (e.g., a central space) for accommodating positioning of a riser or another device therethrough. The base (20) can comprise a plurality of beams or other structural elements adapted for maintaining structural integrity of the floor system (10) and for supporting other portions of the floor system (10). The base (20) can further comprise four guide shafts (25*a-d*) or posts extending at each corner thereof, wherein the guide shafts (25*a-d*) are adapted to guide and/or limit the motion of a floor (30).

The floor (30) is shown positioned above the base (20) and movable relative to the base (20) along the guide shafts (25*a-d*). Similarly to the base (20), the floor (30) can comprise a plurality of beams or other structural elements adapted for maintaining structural integrity of the floor (30) while supporting other portions of the floor system (10) and/or various downhole and subsea equipment positioned thereon. The floor (30) further comprises an open area (e.g., a central space) (32, see FIG. 3) at the center of the floor (30) for accommodating a riser or another device therethrough. Each guide shaft (25*a-d*) is depicted passing through a respective guide bore (35*a-d*) extending through the floor (30) at each corner thereof, such that the guide shafts (35*a-d*) permit vertical movement of the floor (30) relative to the base (20), while preventing pitch, roll, rotational, and/or horizontal (i.e., lateral) movements relative to the base (20).

The four guide shafts (25*a-d*) are depicted in FIGS. 1, 2A, and 2B as generally tubular members passing through a respective generally circular guide bores (35*a-d*) extending through the movable floor (30). However, it should be understood that the guide shafts (25*a-d*) can include any number and type of guiding members without departing from the scope of the present disclosure. In an embodiment, an outer surface of the guide shafts (25*a-d*) and/or the inside surface of the guide bores (35*a*-d) can be used to guide the movement of the floor (30) relative to the base (20). Specifically, the guide bores (35*a-d*) can include tube segments (not shown) welded or otherwise attached to the floor (30). The tube segments can have an inside diameter larger than the outside diameter of the guide shafts (25*a-d*), such that the tube segments are adapted to slide about the guide shafts (25*a-d*) to form a metal-to-metal linear bearing for guiding the movement of the floor (30). In another embodiment of the floor system (10), the guide bores (35*a-d*) can contain one or more linear ball bearings (not shown), located on the inside diameter thereof, which can further reduce the friction between the guide shafts (25*a-d*) and the guide bores (35*a-d*) while maintaining stable vertical motion.

While the base (20) is shown as a generally square-shaped, truss structure, formed from a plurality of metal support beams, it should be understood that other embodiments (not shown) of the floor system (10) can comprise a base (20) having other shapes and/or dimensions, and any structural features, as necessary, to support a movable floor (30) and to engage the deck, hull, or other portion of a vessel. Similarly, while the floor (30) is shown as a generally square-shaped, two-dimensional platform, comprising a plurality of metal support beams and an upper surface (34) (e.g., a screen, mesh, panels, plates, or any other generally durable material) adapted for accommodating personnel and well equipment thereon, other embodiments (not shown) of the floor system (10) can comprise a floor (30) having other shapes, dimensions, and/or materials without departing from the scope of the present disclosure.

FIG. 2A further depicts the floor (30) adapted for movement with respect to the base (20) by way of four hydraulic cylinders (24*a-d*, 24*b* and 24*c* are hidden from view) or other linear actuators. The hydraulic cylinders (24*a-d*) can be pivotally mounted to the base (20) and the floor (30) and be usable to raise and lower the floor (30) away from and toward the base (20), responsive to movement of the vessel (see FIG. 7) or other structure upon which the floor system (10) is installed. FIG. 2B depicts additional means for moving and/or guiding the floor (30) toward and away from the base (20). The floor system (10) is shown comprising rotatable gears (36*a-d*, 36*c* and 36*d* hidden from view) connected by drive shafts with motors (37*a-b*, see FIG. 2A, 37*b* hidden from view), which rotate the gears (36*a-d*) to engage a rack (26*a-d*, 26*c* and 26*d* hidden from view) (e.g., a toothed bar) positioned along each guide shaft (25*a-d*) to move and/or guide the floor (30) along the guide shafts (25*a-d*). It should be understood that the motors (37*a-b*) can include electrical motors, hydraulic motors, or any other rotary actuators known in the art.

Referring again to FIGS. 1, 2A, and 2*b*, a riser tensioner (50) is shown positioned at the center of the floor (30) within the open area (32) and fixably secured to the floor (30). The riser tensioner (50) is depicted comprising an upper portion and a lower base portion, with a central axis (11) extending longitudinally through the riser tensioner (50). The lower base portion comprises a tubular body (51) with a central space or cavity (58) and four hydraulic cylinders (53*a-d*) positioned generally equidistantly along the length of the tubular body (51). The rod ends of the hydraulic cylinders (53*a-d*) can be connected to an upper portion of the riser tensioner (50), which can be moved by the hydraulic cylinders (53*a-d*) toward and away from the tubular body (51). The upper portion of the riser tensioner can comprise a connector bracket (55) having a ring shaped configuration with a space or cavity (57) at the center thereof. The connector bracket (55) can be adapted to receive slips or mechanical grippers (not shown) or comprise other means known in the art for fixably connecting the connector bracket (55) with a riser (70) extending through the cavities (57, 58). FIG. 2B shows the riser (70) further extending through the open areas (22, 32) of the base (20) and the floor (30), respectively, and through a moon pool (85) below the deck (82) of a vessel.

Figure 8:
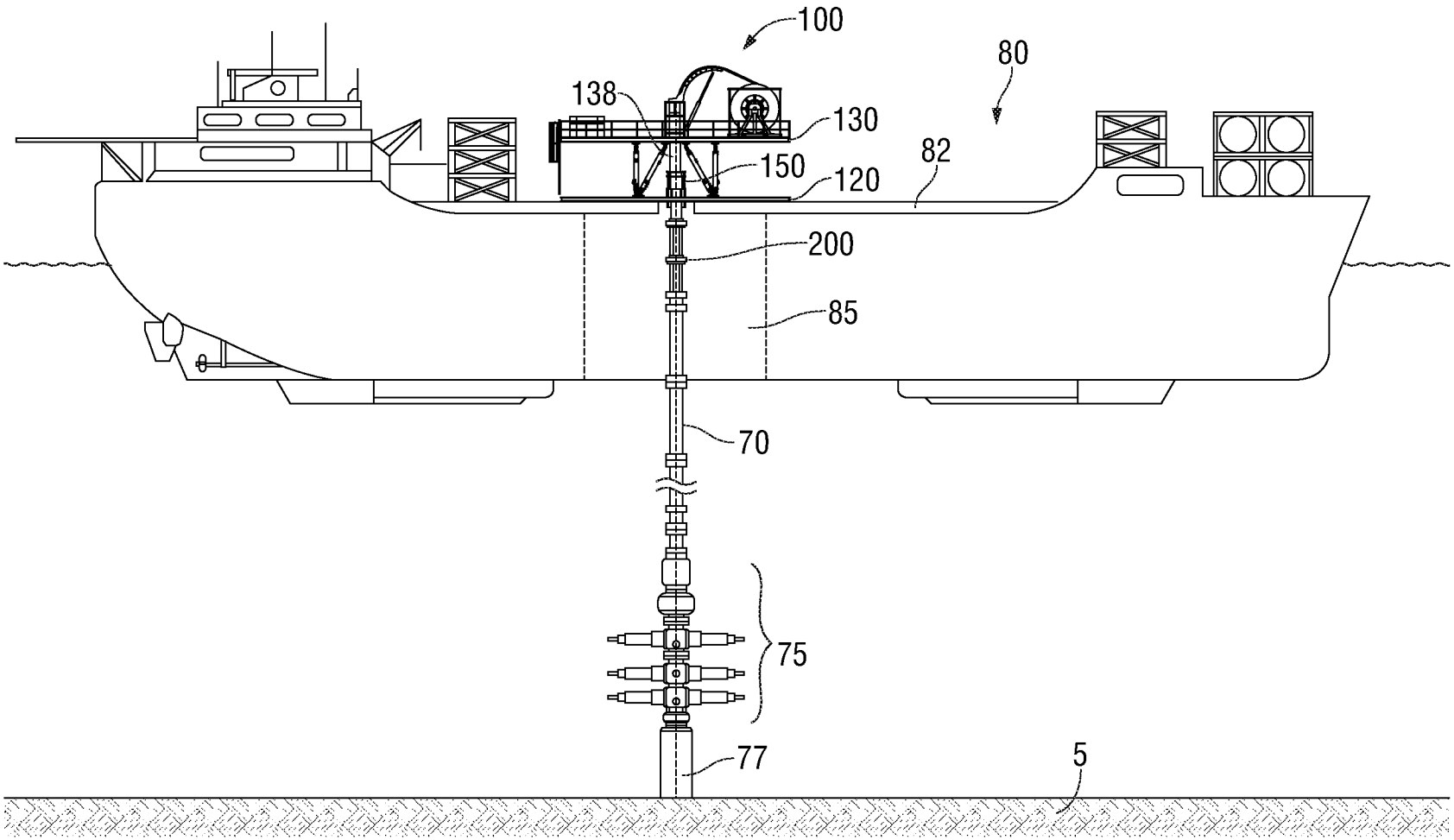
FIG. 8 depicts a partial diagrammatic side view of the motion compensating floor system depicted in FIG. 5, positioned on a vessel and in connection with a subsea riser.

Referring again to FIGS. 2A and 2B showing the floor system (10) positioned on the deck (82) of the vessel (80) over the moon pool (85). As stated previously, during operations, the floor system (10) can stabilize the floor (30) with respect to the riser (70) as the vessel (80) moves due to environmental conditions around it. For example, as the vessel (80) experiences heave, pitch, and/or roll motion due to movement of the sea water, the floor hydraulic cylinders (24*a-d*) can be used to maintain the floor (30) in a generally constant position relative to the riser (70), which may be connected to the sea floor (5), as depicted in FIG. 8. Similarly, the hydraulic cylinders (53*a-d*) of the riser tensioner (50) can be used to maintain the riser (70) at a constant and/or appropriate tension. Thus, as the relative vertical position between the vessel (80) and the riser (70) decreases or increases, the floor hydraulic cylinders (24*a-d*) and the riser tensioner hydraulic cylinders (53*a-d*) can simultaneously extend or retract, eliminating or decreasing changes in such relative position between the floor (30) and the riser (70), while maintaining proper tension on the riser (70). The limits of the system to compensate for relative vertical movement are defined by the sum of the maximum combined strokes of the two sets of cylinders (24*a-d*, 53*a-d*). Therefore, longer strokes can allow the system to compensate for larger heaving motions.

In addition to vertical heave stabilization, the floor system (10) can also compensate for vessel pitch, roll, and yaw motions through independent actuation of selected floor hydraulic cylinders (24*a-d*), enabling the floor (30) to be maintained in a generally fixed angular position relative to the riser (20), as the angular orientation of the vessel changes. The shape and/or dimensions of the guide bores (35*a-d*) and/or guide shafts (25*a-d*), as well as the stroke lengths of floor hydraulic cylinders (24*a-d*) can be selected to enable a desired range of angular movement between the base (20) and the floor (30).

Figure 3:
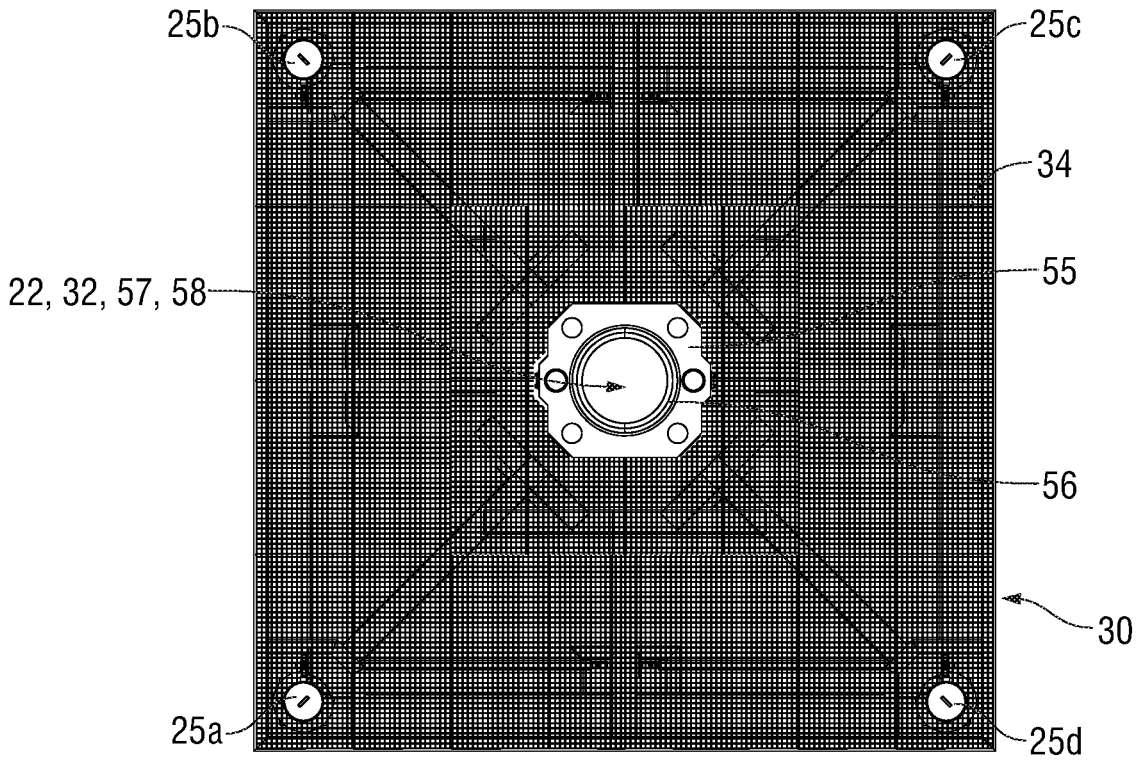
FIG. 3 depicts a top view of the motion compensating floor system depicted in FIG. 1.

Referring now to FIG. 3, depicting a top view of the floor system (10) usable within the scope of the present disclosure. Specifically, the Figure depicts the spherical roller bearing (56) secured within the connector bracket (55), which is positioned over the upper surface (34) of the floor (30). The central cavities (57, 58) of the riser tensioner (50) are shown concentrically positioned with the open areas (22, 32) of the base (20) and the floor (30). The Figure further depicts the upper end of the guide shafts (25*a-d*).

Figure 4:
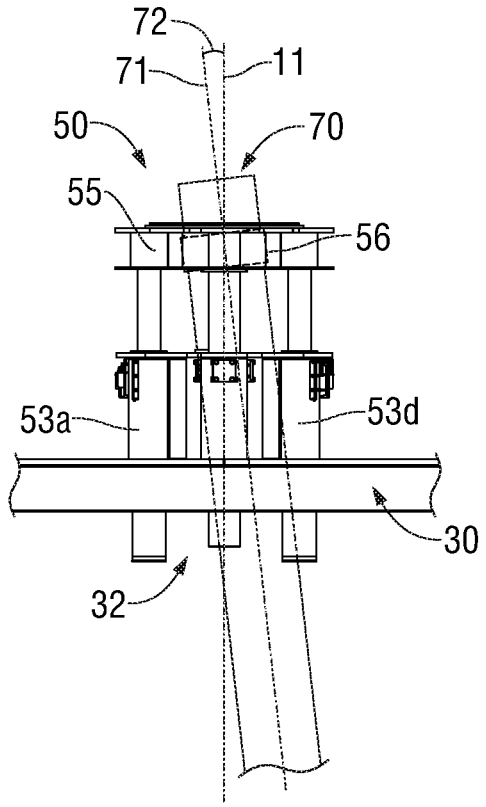
FIG. 4 depicts a diagrammatic side view of an embodiment of a riser tensioner of the motion compensating floor system depicted in FIGS. 1 and 5.

In an embodiment of the floor system (10), the riser tensioner (50) can also reduce structural loads and bending moments due to relative rotation, yaw, pitch, and roll motions between the riser (70) and the vessel (80). Referring now to FIG. 4, showing a diagrammatic side view of an embodiment of the riser tensioner (50) within the scope of the present disclosure. The Figure depicts the connector bracket (55) of the riser tensioner (50) comprising a spherical roller bearing (56), or a gimbal, positioned therein to allow relative angular and/or rotational motion between the riser tensioner (50) and the riser (70) secured therein. For example, as the vessel (80) changes orientation, the riser (70) can remain in a generally fixed angular position due to the relative rotation permitted by the spherical roller bearing (56). In this manner, the vessel (80) can be oriented (e.g., rotated to face a desired direction) without introducing torsion or other stresses or requiring that the connection between the riser tensioner (50) and the riser (70) be released.

Furthermore, the roller bearing also permits angular movement of the riser (70) relative to the riser tensioner (50). Specifically, FIG. 4 depicts a riser angularly offset (72) with respect the riser tensioner, wherein a central axis (71) of the riser (20) is angularly offset (72) from the central axis (11) of the riser tensioner (50). The shape and/or dimensions of the open areas (22, 32) within the base (20) and floor (30), as well as the dimensions of the riser tensioner (50) can be selected to permit a desired range of relative angular movement between the riser (70) and the riser tensioner (50), the floor (30), and/or the base (20), wherein the range of movement between the riser (70) and the riser tensioner (50), the floor (30), and/or the base (20) can be limited by the diameter of the open space (22, 32).

Figure 5:
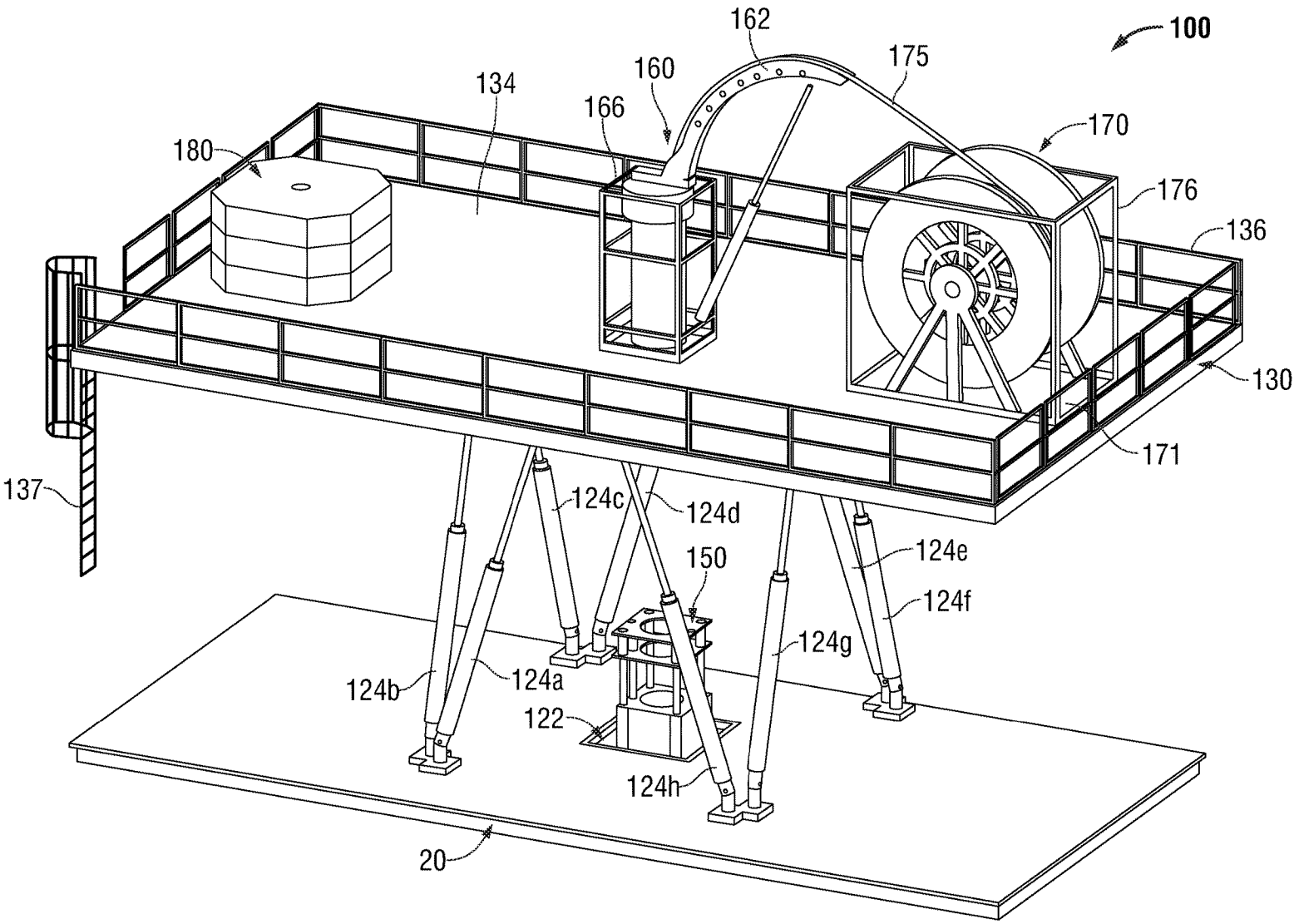
FIG. 5 depicts an isometric view of another embodiment of a motion compensating floor system usable within the scope of the present disclosure.

Referring now to FIG. 5, showing an isometric view of another embodiment of a floor system (100) within the scope of the present disclosure. Similarly to the previously described floor system (10), the floor system (100) depicted in FIG. 5, comprises a base (120) adapted for attachment to the deck of a vessel or a platform that experiences motion. The base (120) is shown comprising a generally rectangular configuration with an open area (122) (e.g., a space) at the center thereof for accommodating a riser or another device therethrough. Although the base (120) is shown comprising a solid plate, the base (120) can comprise a framework of beams or other structural elements adapted for maintaining structural integrity of the floor system (100) and for supporting upper portions of the floor system (100). FIG. 5 further depicts a riser tensioner (150) positioned within the open area (120) and fixably secured to the load bearing portions of the base (120). The riser tensioner (150) depicted in FIG. 5 can have the same or similar configuration as the riser tensioner (50) previously described.

FIG. 5 further depicts a floor (130) positioned above the base (120) and supported by a plurality of fluid cylinders (124*a-h*). The floor (130) is shown comprising a generally rectangular configuration with a central open space (132) at the center thereof. The floor (130) is shown comprising a framework of beams or other structural elements adapted for maintaining structural integrity of the floor (130) while supporting various downhole and/or subsea equipment thereon. The floor (130) further comprises an open area (132) (e.g., a space) at the center thereof for accommodating positioning of a riser and/or another device therethrough. While the floor (130) is shown as a generally rectangular-shaped, two-dimensional platform, comprising a plurality of metal support beams and an upper surface (134) (e.g., a screen, mesh, panels, plates, or any other generally durable material) adapted for accommodating personnel and well equipment thereon, the floor (130) can comprise any shape, dimensions, and/or materials without departing from the scope of the present disclosure. The floor (130) can further include a safety railing system (136) extending above the outer edges of the floor (130). Lastly, the floor (130) can also include a ladder (137) or a staircase (not shown) usable by personnel for moving between the base (20) or the deck (82, see FIG. 8) area and the floor (130).

Figure 6A:
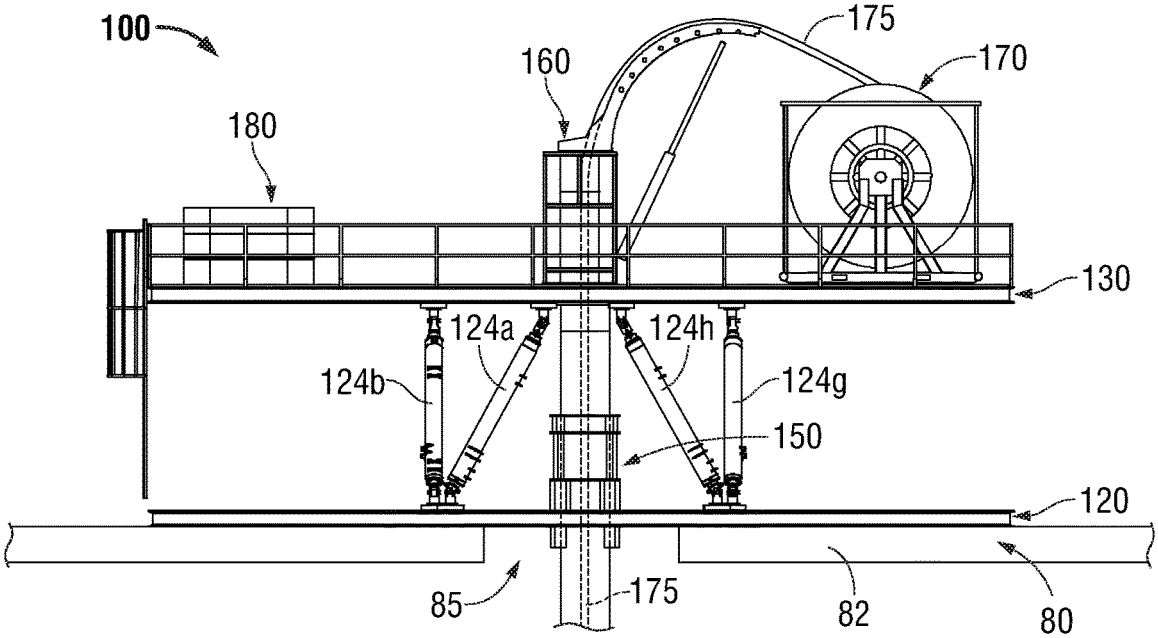
FIG. 6A depicts a side elevational view of the motion compensating floor system depicted in FIG. 5, with a first plurality of cylinders shown in a fully retracted position.
Figure 6B:
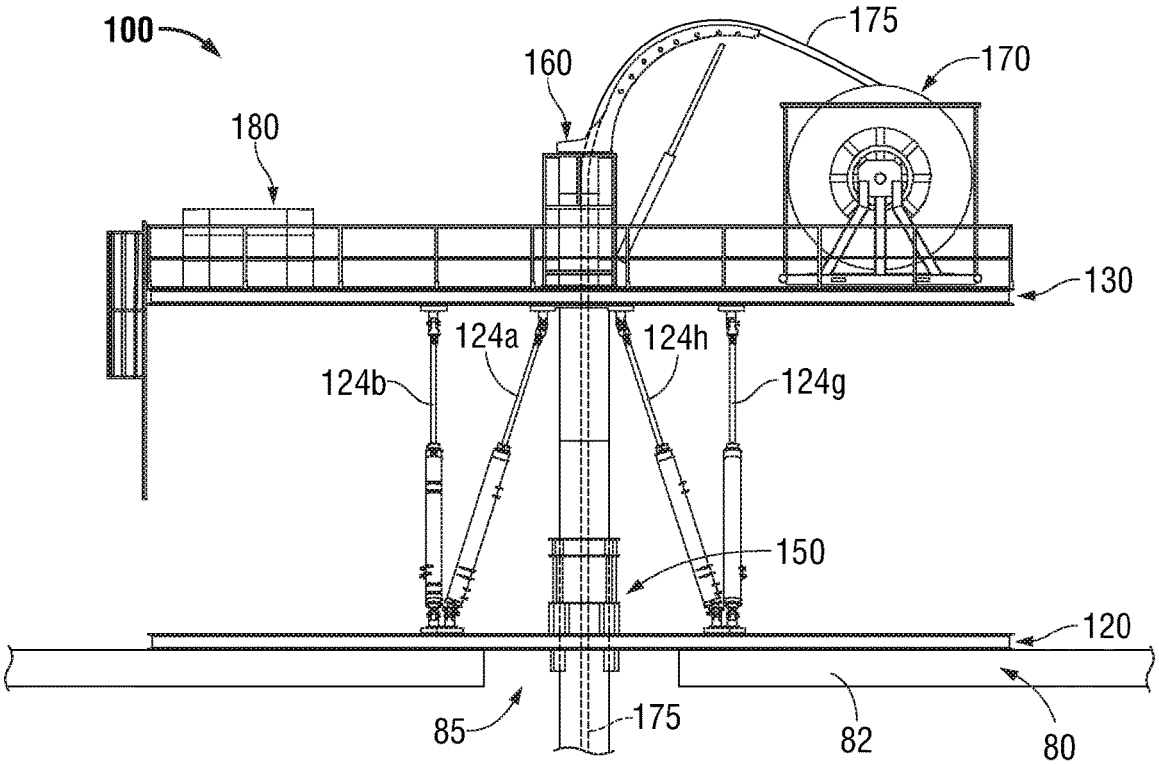
FIG. 6B depicts a side elevational view of the motion compensating floor system depicted in FIG. 5, with the first plurality of cylinders shown in a fully extended position.

FIGS. 5, 6A, and 6B, further depict the floor (130) comprising a coiled tubing system thereon, wherein the coiled tubing system includes equipment required to run coiled tubing operations. The equipment depicted includes a coiled tubing reel (170) to store and transport coiled tubing, an injector head (160) to provide the tractive effort to run and retrieve the coiled tubing, and a power pack (not shown) that generates the necessary hydraulic and/or pneumatic power required to operate the injector head (160), the reel (170), and/or the plurality of fluid cylinders (124*a-h*). The injector head (160) can incorporate profiled chain assemblies (not shown) to grip the coiled tubing (175) and a hydraulic drive system that provides the tractive effort for running and retrieving the coiled tubing from the riser. The gooseneck (162) portion of the injector head (160) mounted on top of the injector head feeds the coiled tubing (175) from the reel (170) around a controlled radius into the injector head (160). The coil tubing injector (160) is shown positioned within the open area (132) of the floor (132) fixably secured to the load bearing portions of the floor (130) framing. Such positioning allows coiled tubing (175) to be directed through the injector head (160) and the floor (130) toward and through the riser tensioner (150). The coil tubing injector (160) further comprises an outer guard (166) usable to protect the coil tubing injector (160) from equipment and other objects being moved about the upper surface (134) of the floor (130).

The coiled tubing reel (170) is a device usable to store and transport coiled tubing (175) for communicating fluids therethrough. The coiled tubing reel (170) can incorporate an internal manifold and swivel arrangement (not shown) to enable various fluids to be pumped through the coiled tubing (175) at any time. The reel (170) is shown comprising a base (171) usable for fixably connecting the reel (170) to the upper surface (134) of the floor (130). The reel (170) further comprises an outer guard (176) usable to protect the coil tubing injector (160) from equipment and other objects being moved about the upper surface (134) of the floor (130).

The injector head (160) and the reel (170) disclosed herein are well known in the art and it is believed that further description of their structure and operation is not necessary for one skilled in the art to practice the apparatus and the method of the present disclosure.

FIGS. 5, 6A, and 6B, further depict a counterweight (180) positioned on one side of the floor (130), namely on the opposite side of the floor (130) with respect to the coiled tubing reel (170). The counterweigh (180) comprises a plurality of stackable plates or other weight members usable to compensate for or counterbalance the weight of the coiled tubing reel (170), which can contain thousands of feet of coiled tubing (175). The weight of the reel (170) can induce significant pivoting forces upon the floor (130), which, in turn, can impede or prevent the desired controlled movement of the floor (130) during operations. The counterweight (180) can be fixably connected to the floor (130) by any known means to prevent the counterweight from sliding or otherwise moving about the upper surface (134) of the floor (130) during operations. In another embodiment (not shown) of the floor system (10), the counterweight (180) can be slidably or otherwise movably positioned on the floor (130), wherein an actuator (not shown), such as a hydraulic cylinder, can move the counterweight (180) toward and away from the reel (170) or the center of the floor (130) to compensate for the changing weight of the reel (170) as the coiled tubing (175) is pushed into the riser or rewound back onto the reel (170).

Referring still to FIGS. 5, 6A, 6B, and 7 the Figures further depict the floor (130) adapted for movement with respect to the base (120) by way of the plurality of hydraulic cylinders (124*a-h*) or other linear actuators. The hydraulic cylinders (124*a-h*) are usable to raise and lower the floor (130) away from and toward the base (120), responsive to movement of the vessel (80, see FIG. 8) deck, hull, or other structure upon which the base (120) is installed. The Figures show the hydraulic cylinders (124*a-h*) extending laterally between the base (120) and the floor (130). Specifically, the cap ends of the hydraulic cylinders (124*a-h*) are shown pivotally connected to the base (120) at four locations arranged in an essentially square pattern around the riser tensioner (150), wherein each set of two hydraulic cylinders is connected to the base at each of the four locations. The rods of the hydraulic cylinders (124*a-h*) are shown pivotally connected to the floor (130) at eight locations arranged in an essentially octagonal pattern around the coiled tubing injector (160). The configuration of the cylinders between the base (120) and the floor (130) results in four sets of two cylinders arranged in a V-shaped formation. The depicted cylinder configuration provides improved stability and motion control of the floor (130), allowing heave, pitch, roll, and yaw motion compensation.

Although the hydraulic cylinders (124*a-h*) are shown connected in a specific configuration, it should be understood that other cylinder configurations or arrangements can be used without departing from the scope of the present disclosure. Furthermore, it should be understood that cylinder stroke lengths and dimensions, bore sizes, the number of cylinders used, as well as the hydraulic fluid pressures and flows required to properly operate the system can be varied depending on specific desired load and/or reaction times (e.g., based on the riser and expected forces/motions), the vessel with which the system is to be used, and other variables. Cylinders designed to be powered by other fluids, such as air or nitrogen, are also usable within the scope of the present invention. Due to the properties of nitrogen which allow rapid movement of the cylinders, nitrogen is the preferred fluid for use in the cylinders.

Figure 7:
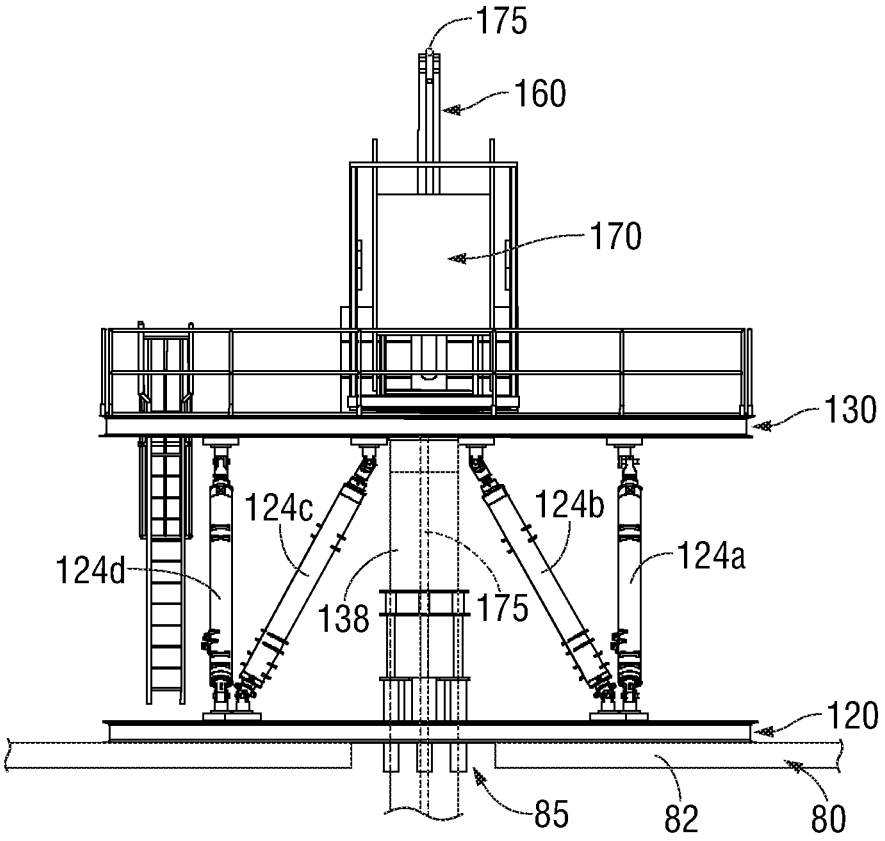
FIG. 7 depicts a front elevational view of the motion compensating floor system depicted in FIG. 5, with a first plurality of cylinders shown in a fully retracted position.

Referring to FIGS. 5 and 8, during operations, the hydraulic cylinders (124*a-h*) can extend and retract simultaneously to compensate for the heave motion of the vessel (80). For example, if the vessel (80) moves closer to the sea floor (5) because it enters the trough of a wave, the hydraulic cylinders (124*a-h*) can extend upward, thereby moving the floor (130) upward, to compensate for the downward displacement of the base (120). If the vessel moves away from the sea floor (5) because it enters the crest of a wave, cylinders (124*a-h*) can retract, thereby moving floor (130) downward, to compensate for the upward displacement of base (120). Additionally, due to placement of the coiled tubing reel (170) on the movable floor (130), relative movement between the riser (70) and the coiled tubing (175) positioned within the riser (70) can be reduced or eliminated, as the floor (130) maintains the coiled tubing reel (170) at the same position with respect to the riser (70). Without motion compensation, the movement of the vessel (80) can cause the coiled tubing (175) to move within the riser (70) and potentially damage the riser (70) and other tools positioned therein. FIGS. 6A and 7 depict the hydraulic cylinders (124*a-h*) in the fully retracted position, while FIGS. 5 and 6B depict the hydraulic cylinders (124*a-h*) in the fully extended position.

To compensate for pitch, roll, and yaw motions of the vessel (80), the hydraulic cylinders can be extended and retracted independently from each other to change the tilt or the vertical angle of the floor surface (134) with respect to the base (120) to reduce or eliminate the motion of the floor surface (134) as the vessel tilts or changes the vertical angle.

In addition, the riser tensioner (150) can maintain the riser (70) at a proper tension. Specifically, when the vessel (80) heaves up and down, the riser tensioner cylinders (53*a-d*, see FIG. 1) retract and extend in unison to prevent the riser from being crushed due to excessive compression or being strained or disconnected due to excessive tension. Furthermore, excessive tension or compression of the riser (70) can cause damage to other subsea equipment that is connected with the riser (70).

During operations, the distance between the base (120) and the floor (130) will change as the floor system (100) compensates for the heaving motion of the vessel (80). A slip joint (138) can be incorporated into the floor system (100) between the coiled tubing injector (160) and the riser tensioner (150) to maintain the coiled tubing (175) and other downhole tools enclosed therein. Specifically, the slip joint (138) can comprise two conduit segments concentrically positioned to allow longitudinal telescopic retraction and extension while maintaining a seal therebetween. The upper end of the slip joint (138) can be positioned within or about the open area (132) and be connected with the load bearing members of the floor (130). The lower end of the slip joint (138) can be positioned within the cavity (57) of the connector bracket (55) or in connection with the connector bracket (55). Accordingly, the slip joint (138) can allow the coiled tubing (175) to be fed from the coiled tubing injector (160) into the riser tensioner (150) while enclosing the coiled tubing (175) therein.

Referring again to FIG. 8, showing one example of the floor system (100) installed on a vessel (80). Specifically, the Figure shows a partial-cross-sectional side view of a vessel (80) with the floor system (100) positioned on the deck (82), with the riser tensioner (150) connected to a riser (70). The riser (70) is shown extending through a moon pool (85) of the vessel (80) toward the sea floor (5), where the riser (70) can be connected to a blowout preventer (BOP) stack positioned over a wellhead (77). An optional external cylindrical heave compensator (200) can be connected between the riser tensioner (150) and the riser (70) to further compensate for the heave motion of the vessel (80).

The present disclosure thereby provides systems and methods usable to compensate for relative motion between a riser and a vessel, and/or between a riser and an inner coiled tubular or tool string, enabling various operations to be performed in, on, and/or through a riser riglessly, independent of heave forces and other motions.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the motion compensating floor system (10, 100) in accordance with the present disclosure can comprise all of the features described above. However, it should also be understood that each feature described above can be incorporated into the motion compensating floor system (10, 100) by itself or in combinations, without departing from the scope of the present disclosure.

What is claimed is:

1. A motion compensating system usable on a vessel during well intervention operations through a riser, wherein the motion compensation system comprises:

an upper floor having an opening therethrough;

a lower base having an opening therethrough, the lower base positioned below the upper floor; and a riser tensioner having an upper portion, a lower portion, and a central cavity extending longitudinally through the upper portion and the lower portion, wherein the upper portion is adapted for connection with a riser or an intermediate tubular member that is connectable to the riser extending through the opening of the upper floor, wherein the lower portion is connected to the lower base within or about the opening of the lower base, wherein the riser tensioner comprises a first plurality of cylinders connected between the upper portion and the lower portion, and wherein the riser tensioner comprises a gimbal permitting full angular motion and rotation between the riser or intermediate tubular member and the riser tensioner.

2. The system of claim 1, wherein a second plurality of cylinders are connected to the upper floor around the opening of the upper floor and connected to the lower base around the opening of the lower base, and wherein each cylinder of the second plurality of cylinders is pivotally connected to move the upper floor with respect to the lower base.

3. The system of claim 2, wherein the second plurality of cylinders are connected to the upper floor at eight locations around the opening of the upper floor.

4. The system of claim 2, wherein the second plurality of cylinders comprise pairs of cylinders, wherein each cylinder of each pair of cylinders extends from the other to form a V-shaped configuration, wherein lower ends of each pair of cylinders are connected to the lower base in proximity to each other, wherein the upper ends of each pair of cylinders are connected to the upper floor apart from each other.

5. The system of claim 1, wherein the lower base is adapted for connection to the deck or hull of the vessel over a moon pool of the vessel.

6. The system of claim 1, further comprising a counterweight in connection with the upper floor, the counterweight balancing the upper floor against the weight of other subsea equipment or downhole equipment positioned on the upper floor.

7. The system of claim 6, wherein the counterweight is movable along the upper floor to adjust the balancing forces produced by the counterweight in response to a change in the weight of the subsea equipment, the other subsea equipment, the downhole equipment, or combinations thereof, positioned on the upper floor.

8. The system of claim 1, wherein the upper floor is adapted to receive thereon a coiled tubing injector and a coiled tubing reel.

9. The system of claim 1, further comprising an extendable or telescoping tubular member extending between the opening of the upper floor and the riser tensioner.

10. A motion compensating system usable to stabilize personnel or equipment located thereon during well intervention operations through a riser, wherein the motion compensation system comprises:

an upper floor having an open space therein;

a lower base having an open space therein positioned below the upper floor;

a riser tensioner apparatus comprising a bracket and a base portion each having a central open space, wherein the bracket comprises a gimbal and connects the riser tensioner to a riser or another member that is connectable with the riser, wherein the base portion is connected to the lower base, wherein a first plurality of cylinders move the bracket toward and away from the base portion, and wherein the gimbal within the bracket angularly pivots and rotates within the riser tensioner permitting rotation between the riser or member connectable with the riser and the base portion; and a second plurality of cylinders extending between the upper floor and the lower base, wherein each cylinder of the second plurality of cylinders is connected to the upper floor and the lower base for moving the upper floor with respect to the lower base.

11. The system of claim 10, wherein the second plurality of cylinders are connected to the upper floor around the open space of the upper floor, connected to the lower base around the open space of the lower base, and wherein each cylinder of the second plurality of cylinders is pivotally connected to move the upper floor with respect to the lower base.

12. The system of claim 10, wherein the lower base is adapted for connection to a deck or a hull of a vessel over a moon pool of the vessel.

13. The system of claim 10, further comprising a counterweight in connection with the upper floor, the counterweight balancing the upper floor against the weight of other subsea or downhole equipment positioned on the upper floor.

14. The system of claim 13, wherein the counterweight is movable along the upper floor to adjust the balancing forces produced by the counterweight in response to a change in the weight of the subsea equipment, the other subsea equipment, the downhole equipment, or combinations thereof, positioned on the upper floor.

15. A method for stabilizing a riser platform on a vessel, the method comprising:

positioning the riser platform above a base platform connected to the vessel such that a riser or intermediate tubular connected to a riser extends through an opening of a lower base of the riser platform;

rotatably connecting, via a bracket comprising a gimbal, the riser or the intermediate tubular connected to the riser to an upper portion of a riser tensioner located on the riser platform, the riser tensioner comprising the upper portion, a lower portion, a central cavity extending longitudinally therethrough, and a first plurality of cylinders, wherein the gimbal and the plurality of cylinders permit a range of rotation and angular motion between the riser tensioner and the riser or the intermediate tubular connected to the riser.

16. The method of claim 15, further comprising actuating the position of a counterweight on the riser platform in response to a change in weight on the riser platform.

17. The method of claim 15, further comprising actuating and pivoting a second plurality of cylinders connecting the lower base of the riser platform with an upper floor of the riser platform differentially in response to a pitch motion, a roll motion, a yaw motion, or combinations thereof, by the vessel.

18. The method of claim 15, further comprising positioning the opening of the lower base of the riser platform over a moon pool of the vessel.

* * * * *